US012344923B2

(12) United States Patent
Kang et al.

(10) Patent No.: US 12,344,923 B2
(45) Date of Patent: Jul. 1, 2025

(54) ZINC PLATED STEEL SHEET HAVING EXCELLENT SPOT WELDABILITY AND MANUFACTURING METHOD THEREOF

(71) Applicant: POSCO, Pohang-si (KR)

(72) Inventors: Ki-Cheol Kang, Gwangyang-si (KR); Sea-Woong Lee, Gwangyang-si (KR); Kyoo-Young Lee, Gwangyang-si (KR); Jong-Ho Kim, Gwangyang-si (KR); Young-Roc Im, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 1015 days.

(21) Appl. No.: 17/415,543

(22) PCT Filed: Dec. 18, 2019

(86) PCT No.: PCT/KR2019/017929
§ 371 (c)(1),
(2) Date: Jun. 17, 2021

(87) PCT Pub. No.: WO2020/130602
PCT Pub. Date: Jun. 25, 2020

(65) Prior Publication Data

US 2022/0056564 A1 Feb. 24, 2022

(30) Foreign Application Priority Data

Dec. 19, 2018 (KR) ..... 10-2018-0165177

(51) Int. Cl.
*C22C 38/38* (2006.01)
*C21D 8/02* (2006.01)
(Continued)

(52) U.S. Cl.
CPC ..... *C22C 38/38* (2013.01); *C21D 8/0205* (2013.01); *C21D 8/0226* (2013.01);
(Continued)

(58) Field of Classification Search
None
See application file for complete search history.

(56) References Cited

U.S. PATENT DOCUMENTS 11,981,973 B2 * 5/2024 Kang ..... C22C 38/008
12,000,008 B2 * 6/2024 Kang ..... C21D 8/0236
(Continued)

FOREIGN PATENT DOCUMENTS

CN 103154297 6/2013
EP 2695963 2/2014
(Continued)

OTHER PUBLICATIONS

European Search Report—European Application No. 19899673.8 issued on Aug. 9, 2021, citing EP 3178961, US 2018/0281348, and EP 2695963.
International Search Report—PCT/KR2019/017929 dated Sep. 7, 2020.

*Primary Examiner* — Daniel J. Schleis
(74) *Attorney, Agent, or Firm* — CANTOR COLBURN LLP

(57) ABSTRACT

Provided is a zinc plated steel sheet having excellent spot weldability and a manufacturing method thereof. The zinc plated steel sheet includes a steel sheet and a zinc plated layer formed on the surface of the steel sheet, wherein the ratio (a/b) between a widthwise average value (a) of thickness of an internal oxidized layer and a widthwise standard deviation (b) of thickness of the internal oxidized layer in the steel sheet may be 1.5 or more.

15 Claims, 1 Drawing Sheet

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |

(52) U.S. Cl.

CPC ..... *C21D 8/0236* (2013.01); *C21D 9/46* (2013.01); *C22C 38/001* (2013.01); *C22C 38/002* (2013.01); *C22C 38/02* (2013.01); *C22C 38/06* (2013.01); *C22C 38/22* (2013.01); *C22C 38/26* (2013.01); *C22C 38/28* (2013.01); *C22C 38/32* (2013.01); *C23C 2/02* (2013.01); *C23C 2/0222* (2022.08); *C23C 2/0224* (2022.08); *C23C 2/024* (2022.08); *C23C 2/06* (2013.01); *C23C 2/28* (2013.01); *C23C 2/40* (2013.01)

(56) References Cited

U.S. PATENT DOCUMENTS

| | | | | |
|---|---|---|---|---|
| 12,054,801 | B2 * | 8/2024 | Kang | C22C 38/06 |
| 2013/0327452 | A1 | 12/2013 | Fushiwaki et al. | |
| 2014/0377585 | A1 * | 12/2014 | Jeon | C22C 38/54 148/533 |
| 2017/0088914 | A1 | 3/2017 | Ikeda et al. | |
| 2018/0010207 | A1 | 1/2018 | Futamura et al. | |
| 2018/0281348 | A1 | 10/2018 | Otomo et al. | |

FOREIGN PATENT DOCUMENTS

| | | | |
|---|---|---|---|
| EP | 3178961 | | 6/2017 |
| JP | 2001262302 | | 9/2001 |
| JP | 2001342541 | | 12/2001 |
| JP | 2007211279 | | 8/2007 |
| JP | 2011231367 | | 11/2011 |
| JP | 2016130358 | | 7/2016 |
| KR | 100868457 | | 11/2008 |
| KR | 20160078827 | | 7/2016 |
| KR | 20160132940 | | 11/2016 |
| KR | 20180069567 | | 6/2018 |
| KR | 20190073200 | A * | 6/2019 |
| WO | 2008147010 | | 12/2008 |

* cited by examiner

[LME CRACK TYPE IN SPOT WELDING PORTION]

ZINC PLATED STEEL SHEET HAVING EXCELLENT SPOT WELDABILITY AND MANUFACTURING METHOD THEREOF

TECHNICAL FIELD

The present invention relates to a zinc plated steel sheet having excellent spot weldability and a manufacturing method thereof.

BACKGROUND ART

Due to problems such as environmental pollution, regulations on vehicle emissions and fuel economy are being strengthened day by day. Accordingly, there is strong demand for reduction of a fuel consumption amount through weight reduction of automobile steel sheets, and therefore, various types of high strength steel sheets having high strength per unit thickness have been developed and released.

High-strength steel generally refers to steel having a strength of 490 MPa or more, but is not necessarily limited thereto, and may refer to transformation induced plasticity (TRIP) steel, twin induced plasticity (TWIP) steel, dual phase (DP) steel, complex phase (CP) steel, or the like.

Meanwhile, automotive steel sheets are supplied in a form of a plated steel sheet that has been plated on a surface thereof to secure corrosion resistance. Thereamong, a galvanized steel sheet (GI steel sheet) or a galvannealed steel sheet (GA) is widely used as a material for automobiles because it has high corrosion resistance using a sacrificial method characteristic of zinc.

However, when the surface of a high-strength steel sheet is plated with zinc, there is a problem that spot weldability is weakened. That is, in the case of high-strength steel, since yield strength is high, in addition to tensile strength, it is difficult to solve tensile stress generated during welding through plastic deformation, and thus there is a high possibility that microcracks may occur on the surface. When welding is performed on a high-strength galvanized steel sheet, zinc with a low-melting point penetrates into the microcracks of the steel sheet, and as a result, a phenomenon called Liquid Metal Embrittlement (LME) occurs, leading to a problem that the steel sheet is destroyed, which may act as a major obstacle to an increase in strength of the steel sheet.

DISCLOSURE

Technical Problem

An aspect of the present disclosure is to provide a zinc plated steel sheet having excellent spot weldability and a method of manufacturing the same.

The subject of the present disclosure is not limited to the above. Those of ordinary skill in the art will have no difficulty in understanding the additional subject of the present disclosure from the general contents of the present specification.

Technical Solution

According to an aspect of the present disclosure, a zinc plated steel sheet includes: a steel sheet; and a zinc-based plated layer formed on a surface of the steel sheet, wherein a ratio (a/b) of a widthwise average value (a) of thickness of an internal oxidized layer of the steel sheet and a widthwise standard deviation (b) of the thickness of the internal oxidized layer may be 1.5 or more.

According to another aspect of the present disclosure, a method of manufacturing a zinc plated steel sheet having excellent spot weldability, includes steps of: hot rolling a steel slab to obtain a hot-rolled steel sheet; coiling the hot-rolled steel sheet at a temperature of 590 to 750° C. to obtain a hot-rolled steel sheet; heating an edge portion of the coiled hot-rolled steel sheet at 600 to 800° C. for 5 to 24 hours; pickling the hot-rolled steel sheet with a 5 to 25% hydrochloric acid solution at a plating speed of 180 to 250 mpm; cold rolling the hot-rolled steel sheet to obtain a cold-rolled steel sheet; annealing the cold-rolled steel sheet in an atmosphere with a dew point of −10 to 30° C. at 650 to 900° C.; and hot-dip galvanizing the annealed cold-rolled steel sheet.

Advantageous Effects

As described above, in the present disclosure, since zinc-based plating is performed on a base steel sheet having an internal oxidized layer having a uniform and sufficient thickness, a possibility that microcracks occur in a surface of the base steel sheet during welding is greatly reduced, thereby preventing a problem of welding defect caused by liquid metal embrittlement (LME), and manufacturing a hot-dip galvanized steel sheet with excellent plating surface quality.

BEST MODE FOR INVENTION

Figure 1:
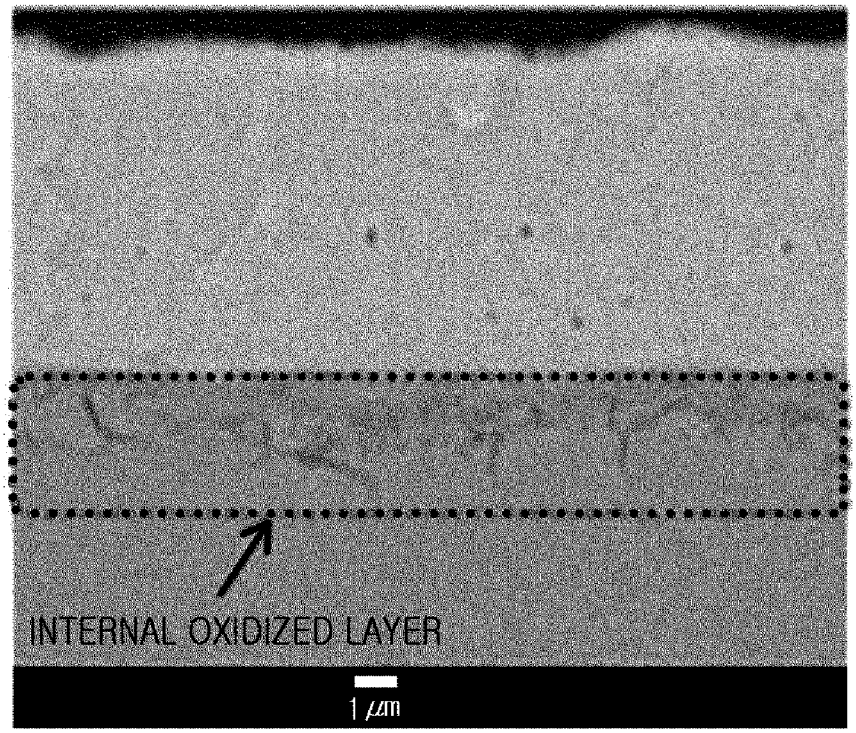
FIG. 1 is a photograph of observing a cross-section of a plated steel sheet manufactured according to Inventive Example 1.

Hereinafter, the present disclosure will be described in detail.

In the present disclosure, it should be noted that the concept of a zinc plated steel sheet includes not only a galvanized steel sheet (GI steel sheet), but also a galvannealed steel sheet (GA), as well as all of the plated steel sheets mainly containing zinc. Mainly containing zinc means that a proportion of zinc is the highest among the elements included in the plated layer. However, in the galvannealed steel sheet, a proportion of iron may be higher than that of zinc, and the proportion of zinc among the remaining components, excluding iron, may be included.

The inventors of the present disclosure focused on the fact that liquid metal embrittlement generated during welding is the cause of the microcracks generated in the surface of the steel sheet, and have conducted research on a means of suppressing the microcracks in the surface. To this end, the inventors of the present disclosure has found that it is necessary to soften a structure of the surface of the steel sheet, as well as to uniformly control a ratio of the soft structure, thereby completing the present disclosure.

That is, in an embodiment of the present disclosure, an internal oxidized layer having an average thickness of a certain level or more is formed on a surface of the steel sheet, and a widthwise standard deviation of the thickness of the internal oxidized layer is controlled to a certain level or less. According to an embodiment of the present disclosure, internal oxides may be present in the internal oxidized layer.

The internal oxides may include at least one or more of Si, Mn, Al, and Fe, and may further include an additional element derived from a composition of the base steel sheet.

When an internal oxidized layer is formed on the surface, hardenable elements such as Mn, Si, or the like are oxidized on the surface and no longer exist in a solid solution state, so that surface hardness can be greatly reduced. When the hardness is reduced, brittleness and residual stress are reduced, thereby reducing an occurrence of microcracks, and thus LME can be greatly suppressed.

Therefore, the greater the thickness of the internal oxidized layer of the steel sheet is, the more advantageous it is to prevent the occurrence of LME. However, due to non-uniform distribution of a cooling rate in a width direction of the coil coiled after hot rolling, a depth of the internal oxidized layer may vary for each position in the width direction. This phenomenon is because internal oxidation is sensitively affected by temperature as well as oxygen potential.

However, when the thickness of the internal oxidized layer varies for each position in the width direction as described above, a degree of occurrence of LME varies in each position, and eventually, a problem occurs in which fracturing occurs in a weak welding portion.

Accordingly, in the present disclosure, a ratio (a/b) of a widthwise average value (a) of thickness of an internal oxidized layer of the steel sheet and a widthwise standard deviation (b) of the thickness of the internal oxidized layer is controlled to be 1.5 or more. In general, as the average value (a) of the thickness of the internal oxidized layer increases, the standard deviation (b) increases correspondingly, so that it is difficult that a/b value has a large value. However, in order to improve spot weldability, it is necessary to minimize variation in LME resistance by setting the a/b value to 1.5 or more. In an embodiment of the present disclosure, the a/b value may be set to 1.7 or more.

In view of the above, the higher the ratio (a/b) is, the more advantageous it is, so that an upper limit thereof does not need be particularly limited. However, when the thickness of the internal oxidized layer is thick in reality, since it is difficult to completely suppress the increase in the standard deviation, an upper limit of the ratio (a/b) may be set to 3.5, and in an embodiment, an upper limit of the ratio (a/b) may be set to 3.0.

In an embodiment of the present disclosure, a widthwise average value (a) of the thickness of the internal oxidized layer may be 3.0 μm or more. The reason for which the widthwise average value of the thickness of the internal oxidized layer is higher than a certain level is to increase the overall LME resistance of the steel sheet. In an embodiment of the present disclosure, the widthwise average value of the internal oxidized layer may be 4.0 μm or more. In terms of securing LME resistance, an upper limit of the widthwise average value of the thickness of the internal oxidized layer does not need to be particularly limited, but when the thickness of the internal oxidized layer is too thick, it may affect the strength of the steel sheet, so an upper limit of the widthwise average value of the thickness of the internal oxidized layer may be set to 10.0 μm, and in an embodiment of the present disclosure, an upper limit of the widthwise average value of the thickness of the internal oxidized layer may be also set to 6.0 μm.

In addition, in an embodiment of the present disclosure, a widthwise standard deviation (b) of the thickness of the internal oxidized layer may be 2.0 μm or less. That is, the lower standard deviation in the width direction can increase the LME resistance for each location, so the widthwise standard deviation (b) of the thickness of the internal oxidized layer may be set to 2.0 μm or less, and in another embodiment of the present disclosure, the widthwise standard deviation (b) of the thickness of the internal oxidized layer may be set to 1.5 μm or less. The lower the standard deviation (b) in the width direction is, the better it is, so a lower limit thereof does not need be particularly set, but the lower limit may be set to 0.5 μm or more or 1.0 μm or more in consideration of practical limitations.

In the present disclosure, the widthwise average value (a) and the widthwise standard deviation (b) of the thickness of the internal oxidized layer may be obtained by dividing an overall width of the steel sheet at equal intervals, then measuring the thickness of the internal oxidized layer at each divided point including the outermost portion, and then obtaining an average value and standard deviation of these values. However, when integrity of the outermost surface of an edge portion becomes a problem, a point about 1 mm from the edge portion is removed, and then each value can be obtained from data of the equally divided points. The interval for dividing the steel sheet may be 25 cm or less, and in an embodiment of the present disclosure, a thickness was obtained by setting the width to 20 cm, and the thickness was used to calculate the average value and the standard deviation.

The type of the steel sheet targeted by the present disclosure is not limited as long as it is a high-strength steel sheet having a strength of 490 MPa or more. However, although not necessarily limited thereto, the steel sheet targeted in the present disclosure may have a composition including, by weight ratio, 0.05 to 1.5% of C, 2.0% or less of Si, 1.0 to 30% of Mn, 3% or less of S—Al (acid-soluble aluminum), 2.5% or less of Cr, 1% or less of Mo, 0.005% or less of B, 0.2% or less of Nb, 0.2% or less of Ti, 0.2% or less of V, 0.1% or less of Sb+Sn+Bi, and 0.01% or less of N. The remainders are iron and other impurities, and it is not excluded that, although not listed above, elements that may be included in the steel are further included to a range of a total of 1.0% or less. In the present disclosure, a content of each component element is expressed based on weight, unless otherwise indicated.

In some embodiments of the present disclosure, the high-strength steel sheet may target TRIP steel, or the like. When subdivided in detail, these steels may have the following composition.

Steel Composition 1:

0.05 to 0.30% of C (preferably 0.10 to 0.25%), 0.5 to 2.5% of Si (preferably 1.0 to 1.8%), 1.5 to 4.0% of Mn (preferably 2.0 to 3.0%), 1.0% or less of S—Al (preferably 0.05% or less), 2.0% or less of Cr (preferably 1.0% or less), 0.2% or less of Mo (preferably 0.1% or less), 0.005% or less of B (preferably 0.004% or less), 0.1% or less of Nb (preferably 0.05% or less), 0.1% or less of Ti (preferably 0.001 to 0.05%), 0.05% or less of Sb+Sn+Bi, 0.01% or less of N, and a balance of Fe and unavoidable impurities. In some cases, although not listed above, elements that may be included in steel may be further included to a range of a total of 1.0% or less.

Steel Composition 2:

0.05 to 0.30% of C (preferably 0.10 to 0.2%), 0.5% or less of Si (preferably 0.3% or less), 4.0 to 10.0% of Mn (preferably 5.0 to 9.0%), 0.05% or less of S—Al (preferably 0.001 to 0.04%), 2.0% or less of Cr (preferably 1.0% or less), 0.5% or less of Mo (preferably 0.1 to 0.35%), 0.005% or less of B (preferably 0.004% or less), 0.1% or less of Nb (preferably 0.05% or less), 0.15% or less of Ti (preferably 0.001 to 0.1%), 0.05% or less of Sb+Sn+Bi, 0.01% or less of N, and a balance of Fe and unavoidable impurities. In some cases, although not listed above, elements that may be included in steel may be further included to a range of a total of 1.0% or less.

In addition, if a lower limit of a content of each of the above-described component elements is not limited, which means that these may be regarded as arbitrary elements, and the content thereof may be 0%.

According to an embodiment of the present disclosure, one or more plated layers may be included on a surface of the steel sheet, and the plated layer may be a zinc-based plated layer including a Galvanized (GI) layer, a Galvannealed (GA) layer, or the like. In the present disclosure, as described above, since a widthwise average value of an internal oxidized layer and a widthwise average deviation thereof are appropriately controlled, even if a zinc-based plated layer is formed on the surface of the steel sheet, a problem of liquid metal embrittlement occurring during spot welding may be suppressed.

When the zinc-based plated layer is a GA layer, an alloying degree (a content of Fe in the plated layer) may be controlled to 8 to 13% by weight, preferably 10 to 12% by weight. If the alloying degree is insufficient, a possibility of liquid metal embrittlement may remain due to the penetration of zinc in the zinc-based plating layer into microcracks. Conversely, if the alloying degree is too high, a problem such as powdering, or the like may occur.

In addition, a plating adhesion amount of the zinc-based plated layer may be 30 to 70 g/m$^2$. If the plating adhesion amount is too low, it may be difficult to obtain sufficient corrosion resistance. On the other hand, if the plating adhesion amount is too high, problems of an increase in manufacturing costs and liquid metal embrittlement may occur, such that the amount of plating adhesion is controlled within the above-described range. A more preferable range of the plating adhesion amount may be 40 to 60 g/m$^2$. This plating adhesion amount refers to an amount of a plating layer adhered to a final product. When a plated layer is a GA layer, the plating adhesion amount increases due to alloying, so a weight thereof may be slightly reduced before alloying, and it is not necessarily limited thereto, because it varies depending on an alloying degree, but the adhesion amount before alloying (that is, an amount of plating from a plating bath) may be a value reduced therefrom by about 10%.

Hereinafter, an embodiment of manufacturing the steel sheet of the present disclosure will be described. However, it is necessary to note that the steel sheet of the present disclosure does not necessarily need to be manufactured according to a following embodiment, and the following embodiment is merely one preferred method of manufacturing the steel sheet of the present disclosure.

A hot-rolled steel sheet can be manufactured by hot-rolling a steel slab of the above-described composition and then coiling it. There is no particular limitation on conditions such as heating (temperature control in the case of direct rolling) or hot rolling of the slab, but in an embodiment of the present disclosure, a coiling temperature may be limited as follows.

Coiling Temperature: 590 to 750° C.

The coiled steel sheet is subjected to a slow cooling process. An internal oxidized layer is formed inside a coil by such a process. If a coiling temperature of a slab is too low, the coil is slowly cooled at a temperature, lower than a temperature required for internal oxidation, so it is difficult to obtain a sufficient effect of internal oxidation. Conversely, when a coiling temperature is too high, a temperature deviation between a central portion and an edge portion in a width direction increases, and accordingly a material deviation increases. In this case, there is a concern that a cold rolling property is deteriorated, and not only strength of a final product is lowered, but also formability is deteriorated. In addition, from a viewpoint of surface oxidation, when a coiling temperature is too high, reoxidation of the scale may occur and $Fe_2O_3$ may be generated. In this case, the surface quality may be deteriorated. Accordingly, in one example of the present disclosure, an upper limit of the coiling temperature may be set to 750° C.

Thereafter, the coiled steel sheet (hot-rolled coil) undergoes a heating process of an edge portion in order to perform further internal oxidization of the edge portion. Specific conditions for heating the edge portion are as follows.

Heating Edge Portion of Hot-Rolled Coil: Performed for 5 to 24 Hours at 600 to 800° C.

In the present disclosure, an edge portion of a hot-rolled coil is heated in order to further reduce a standard deviation (b) of a thickness of an internal oxidized layer in a width direction. Heating the edge portion of the hot-rolled coil means that heating both end portions of the wound coil in a width direction, that is, the edge portion, and the edge portion is first heated to a temperature, appropriately for internal oxidation by heating the edge portion. That is, the wound coil is maintained at a high temperature thereinside, but the edge portion is cooled relatively quickly, so that the time to be maintained at a temperature, suitable for internal oxidation is shorter at the edge portion than that at central portion in a width direction. Accordingly, the thickness of the internal oxidized layer at the edge portion is formed to be thinner than the thickness of the internal oxidized layer at the central portion in the width direction. Heating of the edge portion can be used as a method to solve non-uniformity in the thickness in the width direction.

That is, when the edge portion is heated, as opposed to the case of cooling after coiling, the edge portion is first heated and the temperature of the edge portion in the width direction is maintained appropriately for internal oxidation. As a result, the thickness of the internal oxidized layer of the edge portion increases. To this end, a heating temperature of the edge portion needs to be 600° C. or higher (based on the temperature of the edge portion of the steel sheet). However, when the temperature is too high, since excessive scale is formed on the edge portion during heating, or porous high oxidized scale (hematite) is formed, which may deteriorate a surface condition after pickling, a temperature of the edge portion may be 800° C. or lower. A more preferable heating temperature of the edge portion is 600 to 750° C.

In addition, in order to eliminate non-uniformity of the thickness of the internal oxidized layer generated during coiling, a heating time of the edge portion needs to be 5 hours or longer. However, when the heating time of the edge portion is too long, excessive scale may be formed, or the thickness of the internal oxidized layer of the edge portion may become too thick, resulting in occurring non-uniformity. Therefore, the heating time of the edge portion may be 24 hours or shorter.

According to an embodiment of the present disclosure, heating of the edge portion may be performed by a combustion heating method through adjustment of an air-fuel ratio. That is, an oxygen fraction in an atmosphere may be changed by adjusting the air-fuel ratio, and as the oxygen fraction is higher, a concentration of oxygen in contact with a surface layer of the steel sheet increases, so that decarburization or internal oxidation may increase. Although not necessarily limited thereto, in an embodiment of the present disclosure, the oxygen fraction may be controlled in a nitrogen atmosphere containing 0.5 to 2% by volume of oxygen through air-fuel ratio adjustment. Those of ordinary skill in the art to which the present invention pertains can control the oxygen fraction through air-fuel ratio adjustment without any particular difficulty, so this will not be described separately.

Thereafter, pickling is performed to remove scale on the surface of the hot-rolled steel sheet subjected to heat treatment on the edge portion. Specific pickling conditions are as follows.

Pickling: Pickling was Performed with a 5 to 25% Hydrochloric Acid Solution at a Speed of 180 to 250 Mpm In order to remove the scale formed on the surface of the steel sheet, pickling with a hydrochloric acid solution of 5 to 25% (by volume) can be performed at a speed of 180 to 250 mpm. If a pickling rate is too slow or a concentration of hydrochloric acid is too high, not only the surface scale of the hot-rolled steel sheet is removed, but also base iron may be exposed, such that internal oxidation grain boundaries may be corroded. In this case, a problem such as a flaking dent, or the like may occur, and there is a concern that resistance to LME may decrease due to dissolution of the internal oxidized layer. On the other hand, when the pickling rate is too fast or the concentration of hydrochloric acid is low, scale removal may not be sufficient, so that, in an embodiment of the present disclosure, the pickling rate and the hydrochloric acid concentration can be controlled within the above-described range. In addition, in order to allow the steel sheet to be pickled for an appropriate time, in an embodiment of the present disclosure, a length of the pickling line may be set to 50 to 150 m.

Thereafter, a cold-rolling process and an annealing process may be performed on the pickled hot-rolled steel sheet. In this case, according to an embodiment of the present disclosure, in order to obtain the intended internal oxidized layer, it is advantageous to control an annealing temperature during annealing and a dew point in an annealing furnace in the following manner.

Annealing Condition: Performed at 650 to 900° C. in a Dew Point Atmosphere of −10 to 30° C.

In the present disclosure, a temperature at which annealing is performed may be 650° C. or higher, which is a temperature at which a sufficient internal oxidation effect appears. However, if the temperature is too high, excessive austenite is generated during heating of a soaking zone as well as surface oxides of elements such as Si and so on are formed to prevent oxygen from diffusing into the interior, resulting in lower a carbon diffusion rate, thereby reducing a degree of decarburization. In addition, a load on an annealing furnace may be generated, thereby shortening a lifespan of a facility and increasing process costs. Therefore, a temperature for controlling the dew point may be 900° C. or lower. In the present disclosure, the temperature at which annealing is performed means a temperature of the soaking zone.

In this case, it is advantageous to control a dew point of an atmosphere in an annealing furnace in order to form a sufficient and uniform internal oxidized layer. When the dew point is too low, there is a concern that oxides of elements such as Si or Mn and so on, may be generated on the surface due to surface oxidation rather than internal oxidation. Therefore, the dew point needs to be controlled above −10° C. of higher. Conversely, if the dew point is too high, since there is a concern that oxidation of Fe may occur, the dew point needs to be controlled 30° C. or lower.

In this case, the dew point may be adjusted by introducing wet nitrogen ($N_2$+$H_2O$) containing 1 to 10% by volume of hydrogen into the annealing furnace.

The steel sheet annealed by this process is reheated to a plating bath temperature or higher (460 to 500° C.), and then dipped in a plating bath to perform hot-dip galvanization. According to an embodiment of the present disclosure, the thickness of the annealed steel sheet dipped in the plating bath may be adjusted to 1.0 to 2.0 mm. According to an embodiment of the present disclosure, the plating bath may contain 50% by weight or more of Zn as a zinc-based plating bath.

The hot-dip galvanized steel sheet plated by the above-described process may then be subjected to an galvannealing heat treatment process if necessary. Preferred conditions for the galvannealing heat treatment are as follows.

Galvannealing (GA) Temperature: 480 to 560° C.

If an galvannealing temperature is less than 480° C., an amount of Fe diffusion is small and an alloying degree is insufficient, so plating properties may be defective, and if an galvannealing temperature exceeds 560° C., since a problem of powdering may occur due to excessive alloying, and a material property may be deteriorated due to transformation of residual austenite into ferrite, the galvannealing temperature is set within the above-described range.

In an embodiment of the present disclosure, in order to secure the sufficient alloying degree, the galvannealing heat treatment time may be 1 second or longer. However, if the galvannealing heat treatment time is too long, since the degree of alloying may exceed the range specified in the present disclosure, an upper limit of the alloying heat treatment time may be set to 5 second.

MODE FOR INVENTION

Hereinafter, the present disclosure will be described more specifically with reference to specific examples. The following examples are provided to aid in understanding of the present disclosure, and the scope of the present disclosure is not limited thereto.

Examples

Steel slabs having the composition shown in Table 1 below {remaining components not listed in the table are Fe and inevitably included impurities. in addition, in the table, B and N are expressed in ppm units, the remaining components (expressed in weight % units)} are hot rolled, and then an edge portion of the hot-rolled coil was heated in a nitrogen atmosphere containing oxygen. Thereafter, a steel sheet processing at a passing speed of 210 mpm in a pickling line having a length of 100 mm was pickled with a 19.2 vol % hydrochloric acid solution, then cold-rolled, and the obtained cold-rolled steel sheet was annealed in an annealing furnace and then reheated to 480° C., and then dipped into a zinc-based plating bath containing 0.13% by weight of Al to perform hot-dip galvanization. Thereafter, an adhesion amount was adjusted through air knives. The obtained hot-dip galvanized steel sheet was subjected to an alloying (GA) heat treatment for 4 seconds as necessary to finally obtain an hot-dip galvannealed steel sheet.

In the case of obtaining a hot-dip galvanized steel sheet without performing galvannealing, a cold-rolled steel was annealed and reheated sheet under the above-described conditions, and then dipped in a zinc-based plating bath containing 0.24% by weight of Al to perform plating, and thereafter, after air knifing, the steel sheet was cooled such that a hot-dip galvanized (GI) steel sheet was finally obtained.

In all examples, in order to obtain a steel sheet having a thickness of 1.6 mm, cold rolling was performed at a reduction ratio of 47, a temperature in a soaking cone during annealing was 830° C., a plating speed was 90 mpm, and a ratio of hydrogen contained in wet nitrogen in an annealing furnace was set to 5% by volume. Other conditions for each example are as described in Table 2.

TABLE 1

| Steel type | C | Si | Mn | S-Al | Cr | Mo | B | Nb | Ti | V | Sb | Sn | Bi | N |
|---|---|---|---|---|---|---|---|---|---|---|---|---|---|---|
| A | 0.12 | 1.2 | 2.15 | 0.021 | 0.005 | 0.05 | 15 | 0.021 | 0.045 | 0 | 0 | 0.021 | 0 | 21 |
| B | 0.21 | 1.47 | 2.18 | 0.015 | 0.021 | 0.021 | 11 | 0.012 | 0.047 | 0 | 0 | 0.032 | 0 | 12 |
| C | 0.17 | 1.5 | 2.47 | 0.003 | 0.045 | 0 | 12 | 0.035 | 0.021 | 0 | 0 | 0 | 0 | 11 |
| D | 0.2 | 0.27 | 7.53 | 0.041 | 0.001 | 0 | 14 | 0.021 | 0.031 | 0 | 0 | 0 | 0 | 12 |
| E | 0.12 | 0.05 | 4.12 | 0.021 | 0.0021 | 0.021 | 21 | 0.015 | 0.027 | 0 | 0 | 0 | 0 | 7 |
| F | 0.19 | 0.57 | 2.16 | 0.015 | 0.045 | 0.032 | 14 | 0.012 | 0.014 | 0 | 0.027 | 0 | 0 | 15 |

TABLE 2

| Steel type | Classification | Coiling temperature (° C.) | Heating edge portion: Heating temperature | Heating edge portion: Heating time (time) | Heating edge portion: Oxygen fraction (%) | Annealing Dew point in soaking zone (° C.) | Alloying Temperature (° C.) |
|---|---|---|---|---|---|---|---|
| A | IE 1 | 600 | 650 | 10 | 1.2 | 5.4 | 512 |
| C | CE 1 | 647 | 689 | 10 | 3.45 | 5.7 | 514 |
| F | CE 2 | 621 | 721 | 2.7 | 1.47 | 6.9 | 503 |
| B | CE 3 | 594 | 682 | 10 | 1.19 | 10.8 | 575 |
| F | IE 2 | 610 | 698 | 6 | 1.32 | 20.1 | 521 |
| A | CE 4 | 512 | 620 | 10 | 1.45 | 12.4 | 517 |
| C | CE 5 | 617 | 821 | 8 | 1.54 | 4.5 | 501 |
| F | CE 6 | 532 | 674 | 10.5 | 1.45 | 10.5 | 512 |
| B | CE 7 | 612 | 705 | 37 | 1.45 | 7.4 | 517 |
| C | CE 8 | 621 | 704 | 15 | 1.24 | −25 | 515 |
| E | CE 9 | 612 | 547 | 11 | 1.12 | 7.45 | 512 |
| E | CE 10 | 597 | 715 | 12 | 0.14 | 12.2 | 521 |
| D | IE 3 | 620 | 690 | 7 | 1.21 | 8.1 | — |
| E | CE 11 | 614 | 701 | 9 | 1.14 | 12.6 | 461 |
| C | CE 12 | 614 | 520 | 10 | 1.57 | 9.45 | 508 |
| E | IE 4 | 593 | 720 | 12 | 1.41 | 15.2 | 517 |
| F | CE 13 | 608 | 512 | 9 | 1.47 | 5.45 | 521 |
| C | IE 5 | 621 | 710 | 12 | 1.14 | 6.9 | 496 |
| E | CE 14 | 612 | 687 | 10.5 | 1.24 | −17.4 | 520 |
| D | CE 15 | 604 | 720 | 11.5 | 1.23 | −56.2 | — |
| B | CE 16 | 521 | 678 | 9.5 | 1.54 | 15.2 | 501 |
| A | CE 17 | 621 | 802 | 7.5 | 1.63 | 7.9 | 521 |
| B | IE 6 | 632 | 670 | 8 | 1.23 | 6.9 | 527 |
| F | CE 18 | 645 | 621 | 9.5 | 1.65 | −30.2 | 517 |

*CE: Comparative Example, IE: Inventive Example

Table 3 shows results of measuring the properties of the hot-dip galvannealed (GA) steel sheet manufactured by the above-described process, and observing whether liquid metal embrittlement (LME) occurred during spot welding. An average value (a) of the thickness of the internal oxidized layer in the width direction and standard deviation (b) of the thickness of the internal oxidized layer in the width direction were obtained from data at each point, equally divided at 20 cm intervals after removing a point, which is spaced 1 mm apart from an edge portion of the steel sheet. The steel sheet was cut in the width direction to name an edge portion (Edge), a middle portion (Mid), and a central portion (Cen) in an order from the edge portion to the central portion, and spot welding was performed on the central portion of the cut specimen.

Spot welding was performed under the condition of applying 23 cycles (a cycle means a period of current. 60 Hz AC current was used in these examples) of electricity, 6 cycles of rest, applying 10 cycles of electricity again, and holding 1 cycle.

Figure 2:
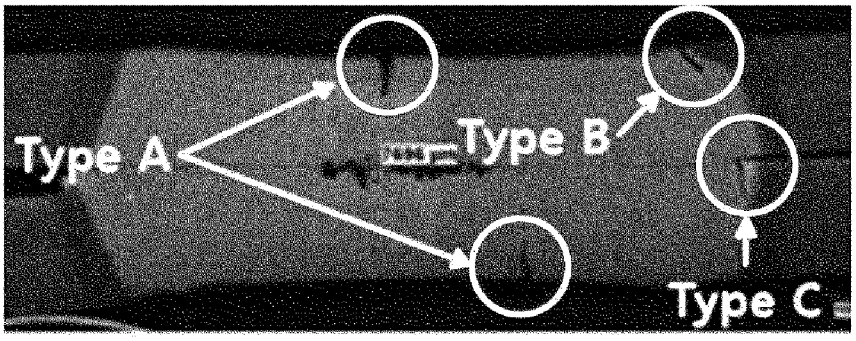
FIG. 2 is a photograph illustrating each crack occurrence location by a type of crack.

In addition, during spot welding as described above, two-type and three-layer welding was performed in which each evaluation material was placed in two layers, and a strength 980 MPa class alloyed hot dip galvanized (GA) DP steel sheet with a thickness of 1.4 mm was superimposed on a lower portion thereof. An electrode having a dome shape of 8 mm in diameter was used, and an inclination angle between an electrode and a specimen was set to 5 degrees. In this case, an upper limit current at which expulsion occurs for each specimen was measured, and spot welding was performed 9 times for each current at Exp-0.2 kA (current 0.2 kA lower than upper limit current) and Exp-0.5 kA (current 0.5 kA lower than upper limit current). In order to determine an occurrence of LME, a maximum length of B-type and C-type cracks of FIG. 2 was measured under the condition that the central portion of the spot welding portion was cut and all cross-sections were observed with an optical microscope at 100-times magnification. In the case of a B-type crack, if a crack having a length exceeding 100 μm exists, it was determined to be defective, otherwise it was determined to be good.

If a C-type crack was observed (no limit in length), it was determined to be defective, otherwise it was determined to be good. If at least one defect occurs in each specimen, the resistance to LME (spot weldability) during welding may be determined to be defective. Table 4 shows the LME measurement results of each Inventive Example and Comparative Example.

TABLE 3

| Steel type | Classification | Average value of thickness of internal oxidized layer in width direction (a) | Average deviation of thickness of internal oxidized layer in width direction (b) | a/b | Tensile strength (MPa) | Plating type | Plating surface quality | Allowing degree (wt %) | Plating adhesion amount (g/m2) |
|---|---|---|---|---|---|---|---|---|---|
| A | IE 1 | 5.20 | 1.75 | 2.97 | 875 | GA | Good | 10.9 | 47 |
| F | IE 2 | 3.20 | 1.95 | 1.64 | 921 | GA | Good | 11.2 | 43 |
| D | IE 3 | 5.47 | 1.94 | 2.82 | 954 | GI | Good | — | 60 |
| E | IE 4 | 3.10 | 1.12 | 2.77 | 782 | GA | Good | 10.4 | 45 |
| C | IE 5 | 5.74 | 1.98 | 2.90 | 1187 | GA | Good | 10.9 | 47 |
| B | IE 6 | 5.40 | 1.87 | 2.89 | 1105 | GA | Good | 11.5 | 48 |
| C | CE 1 | 4.70 | 3.01 | 1.56 | 1204 | GA | Defective | 10.5 | 51 |
| F | CE 2 | 5.40 | 3.65 | 1.48 | 914 | GA | Good | 11.4 | 51 |
| B | CE 3 | 4.10 | 1.94 | 2.11 | 1171 | GA | Defective | 15 | 45 |
| A | CE 4 | 0.45 | 3.70 | 0.12 | 861 | GA | Good | 11.5 | 47 |
| C | CE 5 | 5.20 | 3.21 | 1.62 | 1204 | GA | Defective | 11.2 | 44 |
| F | CE 6 | 1.20 | 4.33 | 0.28 | 903 | GA | Good | 10.4 | 45 |
| B | CE 7 | 3.40 | 2.21 | 1.54 | 1203 | GA | Defective | 9.45 | 45 |
| C | CE 8 | 5.40 | 2.18 | 2.48 | 1214 | GI | Defective | — | 59 |
| E | CE 9 | 6.70 | 3.95 | 1.70 | 796 | GA | Good | 10.2 | 51 |
| E | CE 10 | 4.50 | 3.65 | 1.23 | 801 | GA | Good | 9.98 | 47 |
| E | CE 11 | 5.10 | 1.75 | 2.91 | 774 | GA | Defective | 7.1 | 44 |
| C | CE 12 | 5.40 | 3.45 | 1.57 | 1207 | GA | Good | 10.7 | 43 |
| F | CE 13 | 5.30 | 3.75 | 1.41 | 914 | GA | Good | 10.4 | 45 |
| E | CE 14 | 2.72 | 1.45 | 1.88 | 795 | GA | Defective | 10.1 | 47 |
| D | CE 15 | 1.45 | 1.45 | 1.00 | 956 | GI | Good | — | 62 |
| B | CE 16 | 0.93 | 3.45 | 0.27 | 1178 | GA | Good | 9.5 | 45 |
| A | CE 17 | 5.20 | 1.98 | 2.63 | 895 | GA | Defective | 10.2 | 47 |
| F | CE 18 | 2.45 | 0.75 | 3.27 | 907 | GA | Defective | 9.6 | 45 |

※The average value (a) and standard deviation (b) of the internal oxidized layer in the width direction are in μm units.

TABLE 4

| Steel | | LME Crack length (μm) | | | | | |
|---|---|---|---|---|---|---|---|
| | | Edge | | Mid | | Cen | |
| type | Classification | B-type | C-type | B-type | C-type | B-type | C-type |
| A | IE 1 | Good | Good | Good | Good | Good | Good |
| F | IE 2 | Good | Good | Good | Good | Good | Good |
| D | IE 3 | Good | Good | Good | Good | Good | Good |
| E | IE 4 | Good | Good | Good | Good | Good | Good |
| C | IE 5 | Good | Good | Good | Good | Good | Good |
| B | IE 6 | Good | Good | Good | Good | Good | Good |
| C | CE 1 | Good | Good | Good | Good | Good | Good |
| F | CE 2 | Defective | Defective | Defective | Defective | Good | Good |
| B | CE 3 | Good | Good | Good | Good | Good | Good |
| A | CE 4 | Good | Good | Defective | Defective | Defective | Defective |
| C | CE 5 | Good | Good | Good | Good | Good | Good |
| F | CE 6 | Good | Good | Defective | Defective | Defective | Defective |
| B | CE 7 | Good | Good | Good | Good | Good | Good |
| C | CE 8 | Defective | Defective | Defective | Defective | Defective | Defective |
| E | CE 9 | Defective | Defective | Good | Good | Good | Good |
| E | CE 10 | Defective | Defective | Good | Good | Good | Good |
| E | CE 11 | Good | Good | Good | Good | Good | Good |
| C | CE 12 | Defective | Defective | Defective | Defective | Good | Good |
| F | CE 13 | Defective | Defective | Good | Good | Good | Good |
| E | CE 14 | Defective | Defective | Defective | Defective | Defective | Defective |
| D | CE 15 | Defective | Defective | Defective | Defective | Defective | Defective |

TABLE 4-continued

| Steel | | LME Crack length (μm) | | | | | |
|---|---|---|---|---|---|---|---|
| | | Edge | | Mid | | Cen | |
| type | Classification | B-type | C-type | B-type | C-type | B-type | C-type |
| B | CE 16 | Good | Good | Good | Good | Defective | Defective |
| A | CE 17 | Good | Good | Good | Good | Good | Good |
| F | CE 18 | Defective | Defective | Defective | Defective | Defective | Defective |

Inventive examples 1, 2, 3, 4, 5, and 6 satisfies that a scope suggested by the present disclosure, and a manufacturing method thereof also satisfies the scope of the present disclosure, such that tensile strength, plating surface quality, plating adhesion amount, and a length of LME cracks after spot welding was also good. FIG. 1 is a photograph of an observation of a cutting surface of a steel sheet manufactured according to Inventive Example 1 of the present disclosure, and it can be seen that a uniform internal oxidized layer is formed in a sufficient thickness through the drawing.

In Comparative example 1, a heating temperature of edge portion in the heating furnace and time satisfies the range suggested by the present disclosure, but an oxygen fraction exceeded the range. During the heat treatment process, peroxidation occurred on the edge portion, the surface scale formed as red hematite, and the thickness of the scale became excessively thick. During a pickling process after hot rolling, the edge portion was excessively removed by acid and the surface roughness increased, resulting in a non-uniform surface shape and a defect of non-uniform color having a different surface color from that of the center portion after plating.

Comparative example 2 shows a case in which the heating temperature during the heat treatment of the edge portion satisfies the range of the present disclosure, but the heating time was shorter than the range suggested by the present disclosure. Since sufficient internal oxidation was not formed in the edge portion, deviation of the internal oxidation depth in the width direction exceeded 2 μm, and the edge portion or the middle portion did not meet criteria when evaluating LME cracks during spot welding, which was evaluated as defective.

Comparative example 3 shows a case in which an alloying temperature in a GA alloying process exceeds the range suggested by the present disclosure. Due to a high degree of Fe alloying, the color was dark, resulting in defective surface quality. When GA powdering was evaluated, excessive powdering occurred.

Comparative examples 4, 6, and 16 show cases in which a coiling temperature during a hot rolling process was lower than the range suggested by the present disclosure. Therefore, decarburization of the central portion and the edge portion in the width direction occurring during the hot rolling process is not sufficiently generated, so even if a dew point is high during annealing, the internal oxidation depth of the central portion in the width direction is formed to be less than 3 μm, and the standard deviation of internal oxidation in the width direction also exceeded 2 μm. Therefore, even though the GA alloying degree and plating surface quality were excellent, the center portion and the middle portion were defective when evaluating the LME during spot welding.

In Comparative examples 5 and 17, the heating temperature of heat treatment of the edge portion exceeded the range suggested by the present disclosure, and peroxidation occurred on the edge portion during the heat treatment process, the surface scale formed as red hematite, and the thickness of the scale became excessively thick. During a pickling process after hot rolling, the edge portion was excessively pickled and the surface roughness increased, resulting in a non-uniform surface shape and a defect of non-uniform color having a different surface color from that of the center portion after plating.

In Comparative example 7, the heating temperature for performing a heat treatment satisfies the range of the present disclosure, but peroxidation was generated at the edge portion by an excessive heating time during the heat treatment process, resulting in the formation of red hematite as the surface scale, and the thickness of the scale was excessively large. During a pickling process after hot rolling, the edge portion was excessively pickled and surface roughness increased, resulting in a non-uniform surface shape and a non-uniform color defect having a different surface color from that of the central portion after plating.

Comparative examples 8, 14, 15, and 18 corresponds to cases in which a dew point in a furnace during annealing was lower than the range suggested by the present disclosure. Even if decarburization occurred through sufficient internal oxidation for an overall width during the heating process through hot rolling and heat treatment, the dew point is not sufficiently high during the annealing process after cold rolling, so that carbon was not homogenized and a sufficient level of decarburization cannot be formed, and the length of LME cracks during spot welding was defective in the overall width.

Comparative examples 9, 12, and 13 show cases in that a heating temperature in the heat treatment furnace was lower than the range of the present disclosure. Since sufficient internal oxidation was not formed in the edge portion, the deviation of the internal oxidation depth in the width direction exceeded 2 μm, and the edge portion or the middle portion did not meet the criteria when evaluating the LME cracks during spot welding, which was defective.

Comparative example 10 shows a case in which a heating temperature in the heat treatment furnace and time by performing a heat treatment satisfy the range suggested by the present disclosure, but an oxygen fraction is lower than the range. Since sufficient internal oxidation was not formed in the edge portion, the deviation of the internal oxidation depth in the width direction o exceeded 2 μm, and the edge portion or the middle portion did not meet the criteria when evaluating the LME cracks during spot welding, which was defective.

In Comparative example 11, the alloying temperature in the GA alloying process was lower than the range suggested by the present disclosure. Since the degree of Fe alloying was formed to be lower than normal, the surface was too bright and the surface quality was defective.

Therefore, it was possible to confirm the advantageous effects of the present disclosure.

The invention claimed is:

1. A zinc plated steel sheet having excellent spot weldability, comprising:

a steel sheet; and a zinc-based plated layer formed on a surface of the steel sheet, wherein a ratio (a/b) between a widthwise average value (a) of thickness of an internal oxidized layer and a widthwise standard deviation (b) of thickness of the internal oxidized layer in the steel sheet is 1.5 or more, and wherein the widthwise average value (a) of the thickness of an internal oxidized layer and the widthwise standard deviation (b) of thickness of the internal oxidized layer are obtained by dividing the overall width of the steel sheet at equal intervals, measuring the thickness of the internal oxidized layer at each divided point, and calculating the average and standard deviation of these values.

2. The zinc plated steel sheet having excellent spot weldability of claim 1, wherein the widthwise average value (a) of the thickness of the internal oxidized layer is 3.0 μm or more.

3. The zinc plated steel sheet having excellent spot weldability of claim 1, wherein the widthwise standard deviation (b) of the thickness of the internal oxidized layer is 2.0 μm or less.

4. The zinc plated steel sheet having excellent spot weldability of claim 1, wherein a plating adhesion amount of the zinc-based plated layer is 30 to 70 $g/m^2$.

5. The zinc plated steel sheet having excellent spot weldability of claim 1, wherein the zinc-based plated layer is a galvannealed (GA) layer having an alloying degree of 8 to 13% by weight.

6. The zinc plated steel sheet having excellent spot weldability of claim 1, wherein the steel sheet has a composition including 0.05 to 1.5% of C, 2.0% or less of Si, 1.0 to 30% of Mn, 3% or less of S—Al (acid-soluble aluminum), 2.5% or less of Cr, 1% or less of Mo, 0.005% or less of B, 0.2% or less of Nb, 0.2% or less of Ti, 0.2% or less of V, 0.1% or less of Sb+Sn+Bi, and 0.01% or less of N.

7. A method of manufacturing a zinc plated steel sheet having excellent spot weldability, comprising steps of:

hot rolling a steel slab to obtain a hot-rolled steel sheet;

coiling the hot-rolled steel sheet at a temperature of 590 to 750° C. to obtain a hot-rolled steel sheet;

heating an edge portion of the coiled hot-rolled steel sheet at 600 to 800° C. for 5 to 24 hours;

pickling the hot-rolled steel sheet with a 5-25% hydrochloric acid solution at a plating speed of 180 to 250 mpm;

cold rolling the hot-rolled steel sheet to obtain a cold-rolled steel sheet;

annealing the cold-rolled steel sheet in an atmosphere with a dew point of −10 to 30° C. at 650 to 900° C.; and hot-dip galvanizing the annealed cold-rolled steel sheet.

8. The method of manufacturing a zinc plated steel sheet having excellent spot weldability of claim 7, further comprising a step of galvannealing the hot-dip galvanized cold-rolled steel sheet.

9. The method of manufacturing a zinc plated steel sheet having excellent spot weldability of claim 8, wherein the galvannealing treatment is performed at a temperature of 480 to 560° C.

10. The method of manufacturing a zinc plated steel sheet having excellent spot weldability of claim 7, wherein the steel slab has a composition including 0.05 to 1.5% of C, 2.0% or less of Si, 1.0 to 30% of Mn, 3% or less of S—Al (acid-soluble aluminum), 2.5% or less of Cr, 1% or less of Mo, 0.005% or less of B, 0.2% or less of Nb, 0.2% or less of Ti, 0.2% or less of V, 0.1% or less of Sb+Sn+Bi, and 0.01% or less of N.

11. The zinc plated steel sheet having excellent spot weldability of claim 2, wherein the steel sheet has a composition including 0.05 to 1.5% of C, 2.0% or less of Si, 1.0 to 30% of Mn, 3% or less of S—Al (acid-soluble aluminum), 2.5% or less of Cr, 1% or less of Mo, 0.005% or less of B, 0.2% or less of Nb, 0.2% or less of Ti, 0.2% or less of V, 0.1% or less of Sb+Sn+Bi, and 0.01% or less of N.

12. The zinc plated steel sheet having excellent spot weldability of claim 3, wherein the steel sheet has a composition including 0.05 to 1.5% of C, 2.0% or less of Si, 1.0 to 30% of Mn, 3% or less of S—Al (acid-soluble aluminum), 2.5% or less of Cr, 1% or less of Mo, 0.005% or less of B, 0.2% or less of Nb, 0.2% or less of Ti, 0.2% or less of V, 0.1% or less of Sb+Sn+Bi, and 0.01% or less of N.

13. The zinc plated steel sheet having excellent spot weldability of claim 4, wherein the steel sheet has a composition including 0.05 to 1.5% of C, 2.0% or less of Si, 1.0 to 30% of Mn, 3% or less of S—Al (acid-soluble aluminum), 2.5% or less of Cr, 1% or less of Mo, 0.005% or less of B, 0.2% or less of Nb, 0.2% or less of Ti, 0.2% or less of V, 0.1% or less of Sb+Sn+Bi, and 0.01% or less of N.

14. The zinc plated steel sheet having excellent spot weldability of claim 5, wherein the steel sheet has a composition including 0.05 to 1.5% of C, 2.0% or less of Si, 1.0 to 30% of Mn, 3% or less of S—Al (acid-soluble aluminum), 2.5% or less of Cr, 1% or less of Mo, 0.005% or less of B, 0.2% or less of Nb, 0.2% or less of Ti, 0.2% or less of V, 0.1% or less of Sb+Sn+Bi, and 0.01% or less of N.

15. The method of manufacturing a zinc plated steel sheet having excellent spot weldability of claim 8, wherein the steel slab has a composition including 0.05 to 1.5% of C, 2.0% or less of Si, 1.0 to 30% of Mn, 3% or less of S—Al (acid-soluble aluminum), 2.5% or less of Cr, 1% or less of Mo, 0.005% or less of B, 0.2% or less of Nb, 0.2% or less of Ti, 0.2% or less of V, 0.1% or less of Sb+Sn+Bi, and 0.01% or less of N.

* * * * *